US008579022B2

(12) United States Patent
Cook et al.

(10) Patent No.: US 8,579,022 B2
(45) Date of Patent: Nov. 12, 2013

(54) APPARATUS FOR DEPLOYING AND ACTIVATING A DOWNHOLE TOOL

(76) Inventors: Robert B. Cook, Mandeville, LA (US); Glenn M. Walls, Folsom, LA (US)

( * ) Notice: Subject to any disclaimer, the term of this patent is extended or adjusted under 35 U.S.C. 154(b) by 430 days.

(21) Appl. No.: 13/071,655

(22) Filed: Mar. 25, 2011

(65) Prior Publication Data

US 2012/0241142 A1 Sep. 27, 2012

(51) Int. Cl.
*E21B 43/11* (2006.01)

(52) U.S. Cl.
USPC ..... 166/55; 166/297; 166/63; 175/4.52; 175/4.56

(58) Field of Classification Search
USPC ..... 166/55, 297, 98, 378, 63, 243; 175/4.52, 4.56
See application file for complete search history.

(56) References Cited

U.S. PATENT DOCUMENTS 3,800,705 A * 4/1974 Tamplen ..... 102/222
5,159,145 A * 10/1992 Carisella et al. ..... 89/1.15
5,908,365 A * 6/1999 LaJaunie et al. ..... 175/4.56
5,992,289 A * 11/1999 George et al. ..... 89/1.15

* cited by examiner

*Primary Examiner* — Yong-Suk (Philip) Ro
(74) *Attorney, Agent, or Firm* — Jones Walker LLP

(57) ABSTRACT

An apparatus for deploying and activating a downhole tool activated by an explosive charge such as a drill pipe cutter or hole puncher. The apparatus includes a sealing member with an external wedge-shaped profile that forms a metal-to-metal partial seal with a profile at the top end of a pipe joint in a drill pipe string. The apparatus includes an impact force absorbing device that maintains a firing rod in a non-actuated position during impact of the apparatus. The apparatus includes a differential pressure piston that actuates at a pre-determined well bore pressure to release the firing rod to activate the downhole tool.

20 Claims, 5 Drawing Sheets

APPARATUS FOR DEPLOYING AND ACTIVATING A DOWNHOLE TOOL

BACKGROUND OF THE INVENTION

The present invention relates to an apparatus for deploying and activating a downhole tool.

SUMMARY OF THE INVENTION

The present invention is drawn to a novel apparatus for deploying and activating a downhole tool such as a tool activated by an explosive charge. Such tools include, for example, a drill pipe cutter or hole puncher tool. The apparatus includes may include but does not need to include a retrieving member having an upper section and a lower section. The upper section of the retrieving member has a fish neck profile for connection of a fishing tool. The apparatus includes an upper tubular member having an upper section and a lower section. The upper section of the upper tubular member is detachably connected to the lower section of the retrieving member. The apparatus includes a sealing plug member having an upper section and a lower section. The upper section of the sealing plug member is detachably connected to the lower section of the upper tubular member. The apparatus includes an upper piston cylinder member having an upper section, a lower section, and an internal bore. The upper section of the upper piston cylinder member is detachably connected in sealing relationship to the lower section of the sealing plug. The apparatus includes a shear pin housing member having an upper section, a lower section, an internal shoulder, an internal bore, and an orifice providing a well bore fluid passageway to the internal bore of the shear pin housing member. The apparatus includes a sealing member having an upper section, a lower section, an internal bore, and an external wedge-shaped profile capable of forming a partial seal within a drill pipe string sufficient to cause an increase in fluid pressure above the sealing member when seated in a pipe joint. The upper section of the sealing member is detachably connected in sealing relationship to the lower section of the shear pin housing. The apparatus includes a lower seal housing having an upper section, a lower section, and an internal bore. The upper section of the lower seal housing is detachably connected in sealing relationship to the lower section of the sealing member. The apparatus includes a lower tubular member having an upper section, a lower section, and an internal bore. The upper section of the lower tubular member is detachably connected in sealing relationship to the lower section of the lower seal housing. The apparatus includes an ignitor sub having an upper section and a lower section. The upper section of the ignitor sub is detachably connected in sealing relationship with the lower section of the lower tubular member.

The apparatus also includes a differential pressure piston having a plunger section and a stem section. The plunger section has an upper end and a lower end. The stem section has a lower end. The upper end of the plunger section includes one or more sealing means. The lower end of the plunger section includes one or more sealing means. The lower end of the plunger section cooperatively engages the shoulder of the shear pin housing member when the differential pressure piston is in a stationary, non-actuated position. The apparatus also includes a female locking piston having an upper section and a lower section. The upper section of the female locking piston contains a recess accommodating the lower end of the stem section of the differential pressure piston when the differential pressure piston is in the stationary, non-actuated position. The upper section of the female locking piston includes an impact force absorbing means operatively associated with the lower end section of the stem section of the differential pressure piston. The female locking piston includes one or more sealing means. The apparatus also includes a firing rod having an upper section and a lower section. The upper section of the firing rod is detachably connected to the lower section of the female locking piston. In the apparatus, the shear pin housing member includes one or more shear pins selectively retaining the differential pressure piston in the stationary, non-actuated position.

In an alternative embodiment, the upper tubular member of the apparatus includes a first mandrel member having an upper section, a lower section, and an external rubber cup assembly. The upper section of the first mandrel member is detachably connected to the lower section of the retrieving member. The upper tubular member also includes a first coupling member having an upper section and a lower section. The upper section of the first coupling member is detachably coupled to the lower section of the first mandrel member. The upper tubular member also includes a longitudinally extending tubular member having an upper section, a lower section, and a mid-section containing a bow string centralizer assembly. The upper section of the longitudinally extending tubular member is detachably coupled to the lower section of the first coupling member. The upper tubular member also includes a second coupling member having an upper section and a lower section. The upper section of the second coupling member is detachably coupled to the lower section of the longitudinally extending tubular member. The upper tubular member also includes a second mandrel member having an upper section, a lower section, and an external rubber cup assembly. The upper section of the second mandrel member is detachably connected to the lower section of the second coupling member. The lower section of the second mandrel member is detachably connected to the upper section of the sealing plug member.

In the alternative embodiment, the external rubber cup assembly of the first and second mandrel members may each include a plurality of rubber cup-like projections capable of causing a well bore fluid drag force during deployment of the apparatus in the drill pipe string or receiving a fluid pressure force to push the apparatus down the drill pipe string during deployment.

In the alternative embodiment, the bow string centralizer assembly may include a plurality of centralizers capable of causing a drag force by contacting an inner bore wall of the drill pipe string during deployment of the apparatus.

In the apparatus, the sealing plug member may include one or more annular sealing means.

In the apparatus, the shear pin housing member may include one or more annular sealing means.

In an alternative embodiment of the apparatus, the lower seal housing may include a first seal housing member having an upper section, a lower section, and an internal bore. The upper section of the first seal housing is detachably connected in sealing relationship to the lower section of the sealing member. The lower seal housing also includes a second seal housing having an upper section, a lower section, and an internal bore. The upper section of the second seal housing is detachably connected to the lower section of the first seal housing. The lower section of the second seal housing is detachably connected in sealing relationship to the upper section of the lower tubular member.

In the alternative embodiment, the lower section of the first seal housing may include one or more recesses. Each recess may house a set screw to maintain the connection of the lower section of the first seal housing to the upper section of the second seal housing.

In the alternative embodiment, the lower section of the second seal housing may include one or more annular sealing means.

In the apparatus, the lower tubular member may include a bow string centralizer assembly. The bow string centralizer assembly includes a plurality of centralizers capable of causing a drag force by contacting an inner bore wall of the drill pipe string during deployment of the apparatus.

In the apparatus, the lower section of the lower tubular member may include one or more annular sealing means.

In the apparatus, the impact force absorbing means includes a groove and a plurality of metal balls retained within the groove. The metal balls contact the lower end of the stem section of the differential pressure piston when the differential pressure piston is in the stationary, non-actuated position.

In the apparatus, the metal balls may be made of steel.

In the apparatus, when the differential pressure piston is in a fully actuated position, the shear pins have sheared at a pre-determined well bore fluid pressure, the differential pressure piston has moved upwards within the internal bore of the upper piston cylinder member displacing the lower end of the stem section of the differential pressure piston from the recess in the upper section of the female locking piston causing the metal balls to be displaced from the groove in the upper section of the female locking piston, and the female locking piston and connected firing rod have moved downward causing the lower section of the firing rod to actuate the ignitor sub.

In one embodiment of the apparatus, the one or more sealing means of upper end of the plunger section comprise an upper O-ring and a lower O-ring and wherein the one or more sealing means of the lower end of the plunger section comprise an upper O-ring and a lower O-ring. In this embodiment, the lower O-ring of the upper end of the plunger section and the upper and lower O-rings of the lower end of the plunger section each have a ring-diameter size that is equal. In a further embodiment, the upper O-ring of the upper end of the plunger section has a ring-diameter size larger than the ring-diameter size of the lower O-ring of the upper end of the plunger section and the upper and lower O-rings of the lower end of the plunger section.

An advantage of the apparatus is its ability to be dropped several miles down the drill pipe string where it impacts the profile in the top end of the pipe joint without inadvertently activating the firing rod.

Another advantage of the apparatus is its ability to break circulation again after seating and cutting to have an indication of activation and to permit drill fluid to exit the drill pipe string on the way out of the well.

Yet another advantage of the apparatus is the ability of the differential pressure piston to move in an upward direction.

Yet another feature of the present invention is the ability of the bow spring centralizers and rubber cup assemblies to cause a drag force thereby slowing down the rate of fall of the apparatus when being deployed through the drill pipe string.

Yet another feature of the present invention is the ability to reserve the orientation of the rub cup assemblies so that the cups are used to propel the apparatus down the drill pipe string via fluid pressure applied at the well surface.

DETAILED DESCRIPTION OF THE INVENTION

Figure 1A:
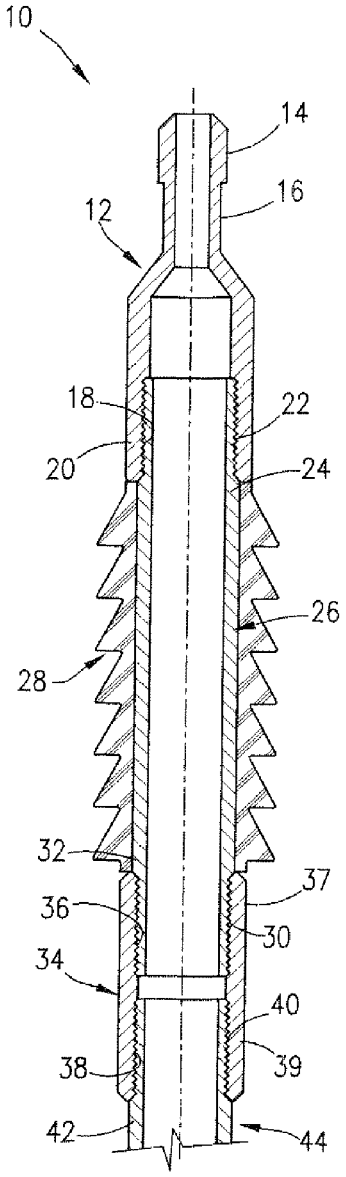
FIGS. 1A-1F are a sequential cross-sectional view of an embodiment of the apparatus of the present invention in a non-actuated position.

FIGS. 1A-1F show an embodiment of apparatus 10 of the present invention. Apparatus 10 includes retrieving member 12. It is to understood that retrieving member 12 is optional and does not need to be included as part of apparatus 10. Without retrieving member 12, apparatus 10 may be pulled from the well bore when the drill pipe in which apparatus 10 is seated is pulled from the hole. Fish neck profile 14 is provided on upper section 16 of member 12. A fishing tool (not shown) detachably affixes to fish neck profile 16 for the retrieval of apparatus 10 from a well bore when apparatus 10 has been deployed downhole. Internal threads 18 are provided on lower section 20 of member 12. Threads 18 threadedly connect with mating external threads 22 on upper section 24 of first cup mandrel 26. Mandrel 26 contains first external rubber swab cup 28 that includes a series of cup-like projections. Cup 28 is designed to float apparatus 10 during its deployment from the well surface to reduce the fall rate of apparatus 10. External threads 30 are provided on lower section 32 of mandrel 26.

With reference to FIGS. 1A-1F, first coupling 34 includes internal threads 36 on upper section 37 and internal threads 38 on lower section 39. Internal threads 36 threadedly connect with mating external threads 30 of mandrel 26. Internal threads 38 threadedly connect with external threads 40 on upper section 42 of tubular member 44. Bow spring centralizer assembly 46 is positioned on tubular member 44. Assembly 46 contains a plurality of centralizers 48 that are designed to contact the inner diameter surface of the drill pipe string through which apparatus 10 is deployed to provide drag and thereby reduce the fall rate of apparatus 10.

As shown in FIGS. 1A-1F, external threads 50 on lower section 51 of tubular member 44 threadedly connect with mating internal threads 52 on upper section 54 of second coupling 56. Internal threads 58 on lower section 60 of coupling 56 threadedly connect with mating external threads 62 on upper section 64 of second cup mandrel 66. Mandrel 66 contains second external rubber swab cup 68 that includes a series of cup-like projections. Cup 68 is designed to float apparatus 10 during its deployment from the well surface to reduce the fall rate of apparatus 10. External threads 70 are provided on lower section 72 of mandrel 66.

FIGS. 1A-1F shows that internal threads 74 of upper section 76 of sealing plug 78 threadedly connect with mating external threads 70 of mandrel 66. External threads 80 on lower plug section 82 of sealing plug 78 threadedly connect with internal threads 84 on upper section 86 of upper piston cylinder member 88. O-rings 90, 92 seat in grooves 94, 96 on lower plug section 82 and provide an annular seal between plug section 82 and member 88. External threads 98 on lower section 100 of member 88 threadedly connect with mating internal threads 102 on upper section 104 of shear pin housing 106. Member 88 contains internal bore 108.

FIGS. 1A-1F reveal that external threads 110 on lower section 112 of housing 106 threadedly connect with external threads 114 on upper section 116 of sealing member 118. O-rings 120, 122 seat in grooves 124, 126 in lower section 112 of housing 106 to provide an annular seal between lower section 112 of housing 106 and upper section 116 of sealing member 118. Housing 106 has orifice 128 extending through housing 106 to inner bore 130 for the selective passage of well bore fluids. Housing 106 also includes a plurality of shear pin or screw receptacles 132. Each receptacle 132 contains shear pin or screw 134. Housing 106 further includes internal shoulder 136. The material forming shoulder 136 may be composed of a metal or other heat and pressure resistant material that is harder than the metal or steel material forming the remainder of housing 106. The material forming shoulder 136 may be a high strength steel.

As seen in FIGS. 1A-1F, internal threads 138 on lower section 140 of sealing member 118 threadedly connect with mating threads 142 on upper section 144 of first lower seal housing 146. Sealing member 118 has external profile 148 that mates with a corresponding profile on the top end of a pipe joint (not shown) connected to the drill pipe string (not shown) when apparatus 10 is deployed downhole. Profile 148 includes outwardly extending wedged-shaped section 150. The mating of sealing member 118 via profile 148 (i.e., wedged-shaped section 150) with the corresponding profile on the top end of the pipe joint forms a metal-to-metal seal permitting a pressuring up of the fluid pressure in the drill pipe string above sealing member 118 to activate apparatus 10 as will be described herein. Sealing member 118 contains internal bore 152.

As also illustrated in FIGS. 1A-1F, internal threads 154 on lower section 156 of housing 146 threadedly connected with mating external threads 158 on upper section 160 of second lower seal housing 162. O-rings 164, 166 seat in grooves 168, 170 on upper section 144 of housing 146 to provide an annular seal between housing 146 and sealing member 118. Orifice 172 in housing 146 provides a passageway for well bore fluids into internal bore 174. One or more set screw receptacles 176 are provided in lower section 178 of housing 146. Each receptacle 176 contains set screw 180 securing housing 146 to housing 162. Housing 162 contain internal bore 181.

Again with reference to FIGS. 1A-1F, internal threads 182 on lower section 184 of housing 162 threadedly connect with mating external threads 186 on upper section 188 of tubular member 190. O-rings 192, 194 seat in grooves 196, 198 in upper section 188 of member 190 and provide an annular seal between upper section 188 of member 190 and lower section 184 of housing 162. Bow spring centralizer assembly 200 is positioned on tubular member 190. Assembly 200 contains a plurality of centralizers 202 that are designed to contact the inner diameter surface of the drill pipe through which apparatus 10 is deployed to provide drag and thereby reduce the fall rate of apparatus 10. Member 190 contains internal bore 203. External threads 204 on lower section 206 of member 190 threadedly connect with mating internal threads 208 on upper section 210 of igniter sub 212. O-rings 214, 216 seat in grooves 218, 220 on lower section 206 of member 190 and provide an annular seal between lower section 206 of member 190 and upper section 210 of igniter sub 212. During deployment of apparatus 10, a drill pipe cutting tool (not shown), such as a jet cutter, would be operatively secured to lower section 222 of igniter sub 212.

Figure 1B:
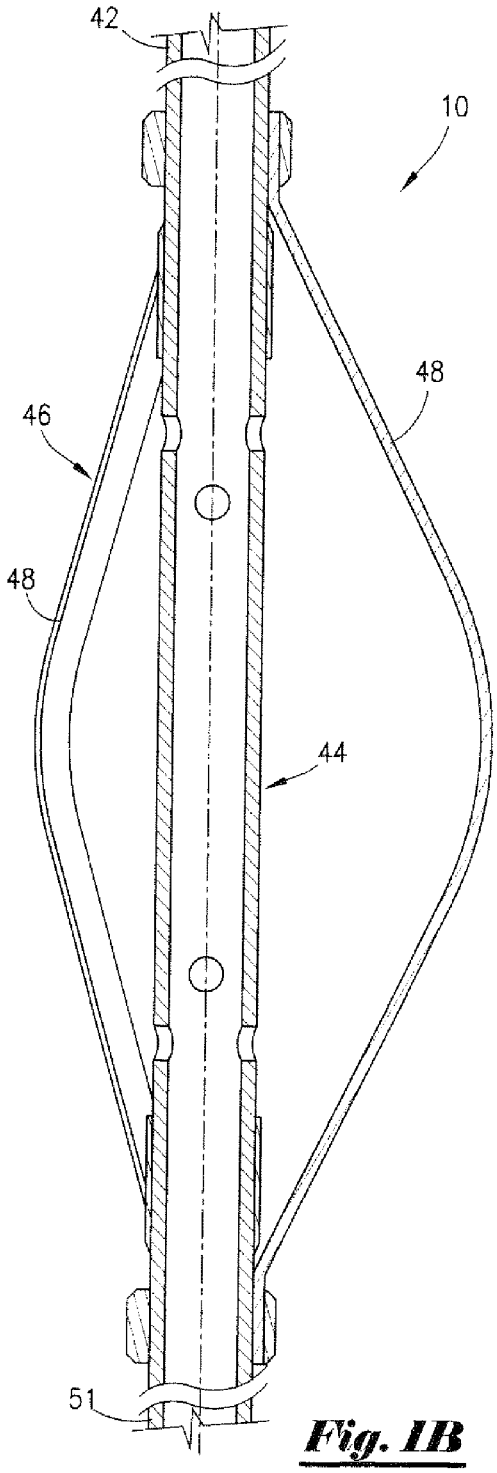
Figure 1C:
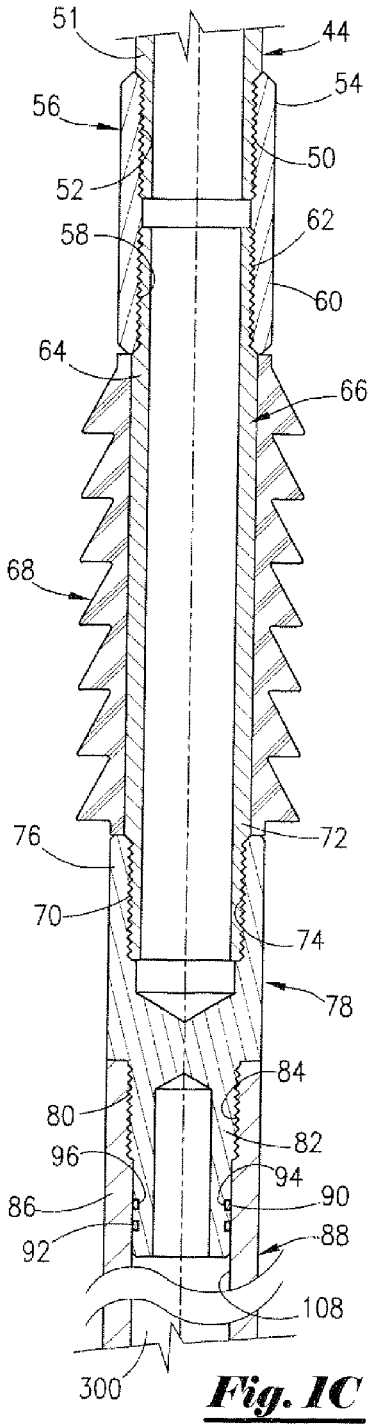
Figure 1D:
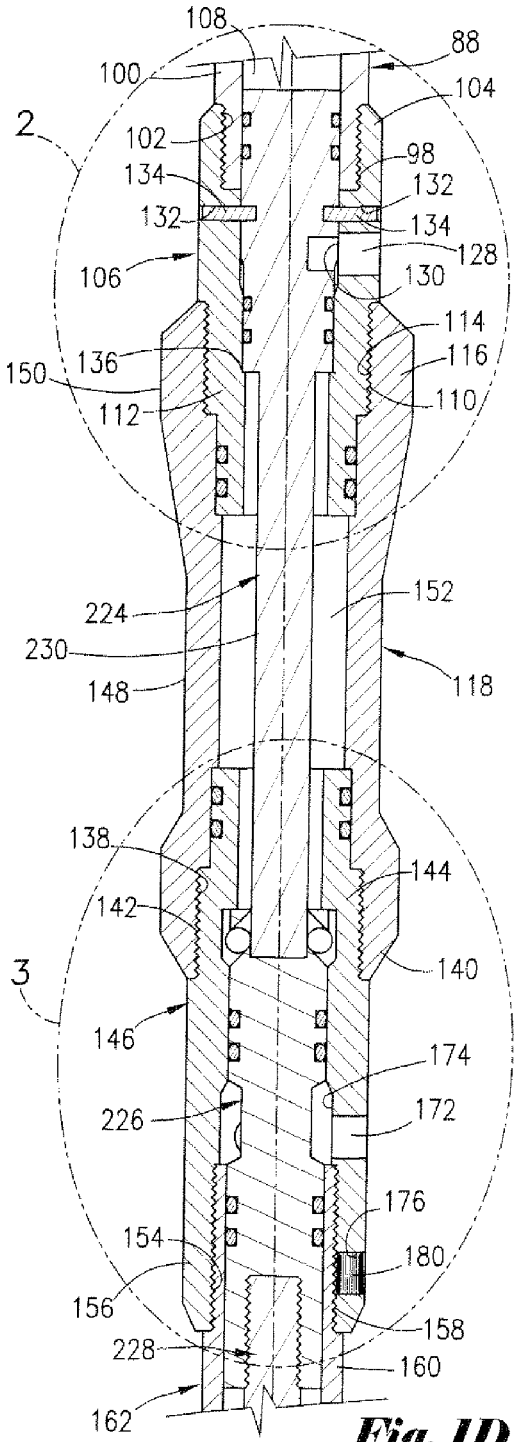
Figure 1E:
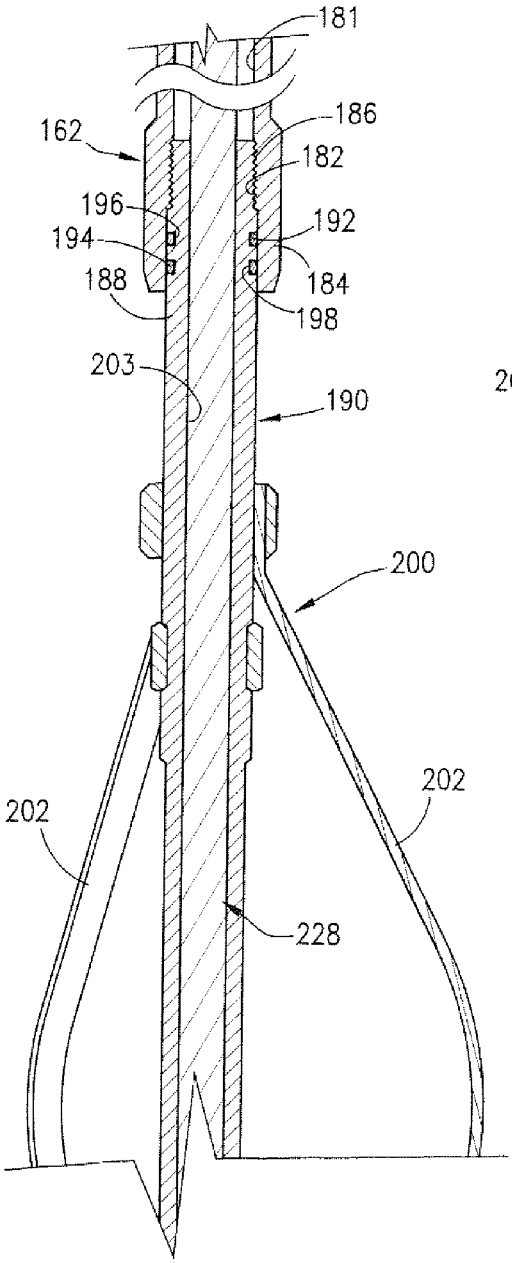
Figure 1F:
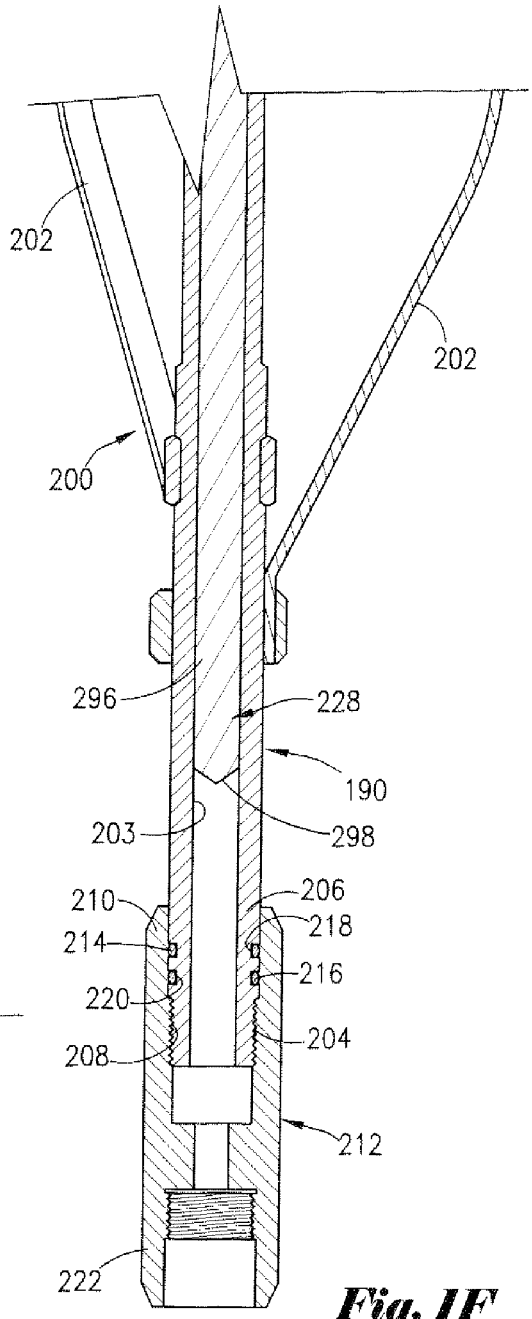
Figure 2:
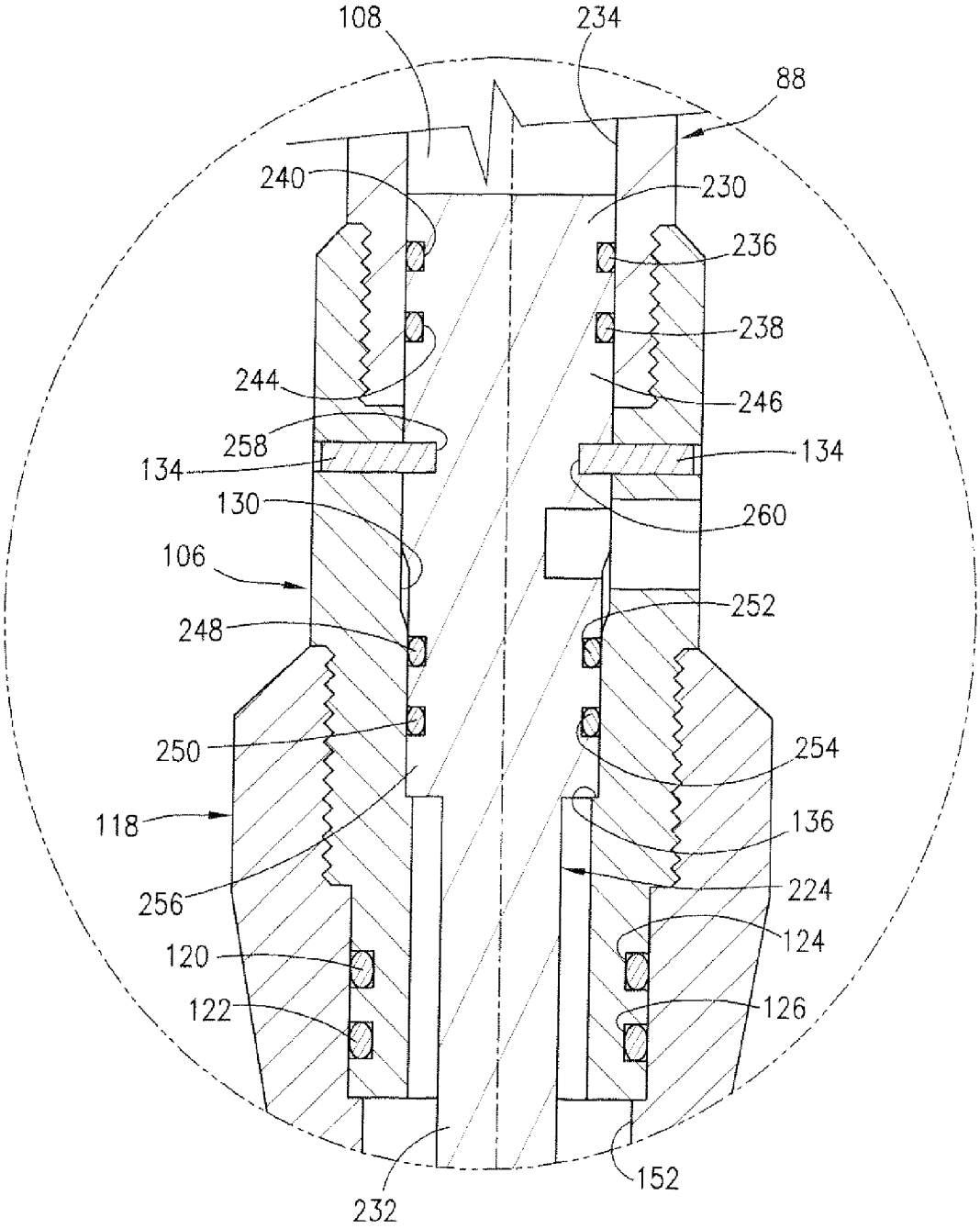
FIG. 2 is a partial cross-sectional view of the section designated as "2" in FIG. 1D.
Figure 3:
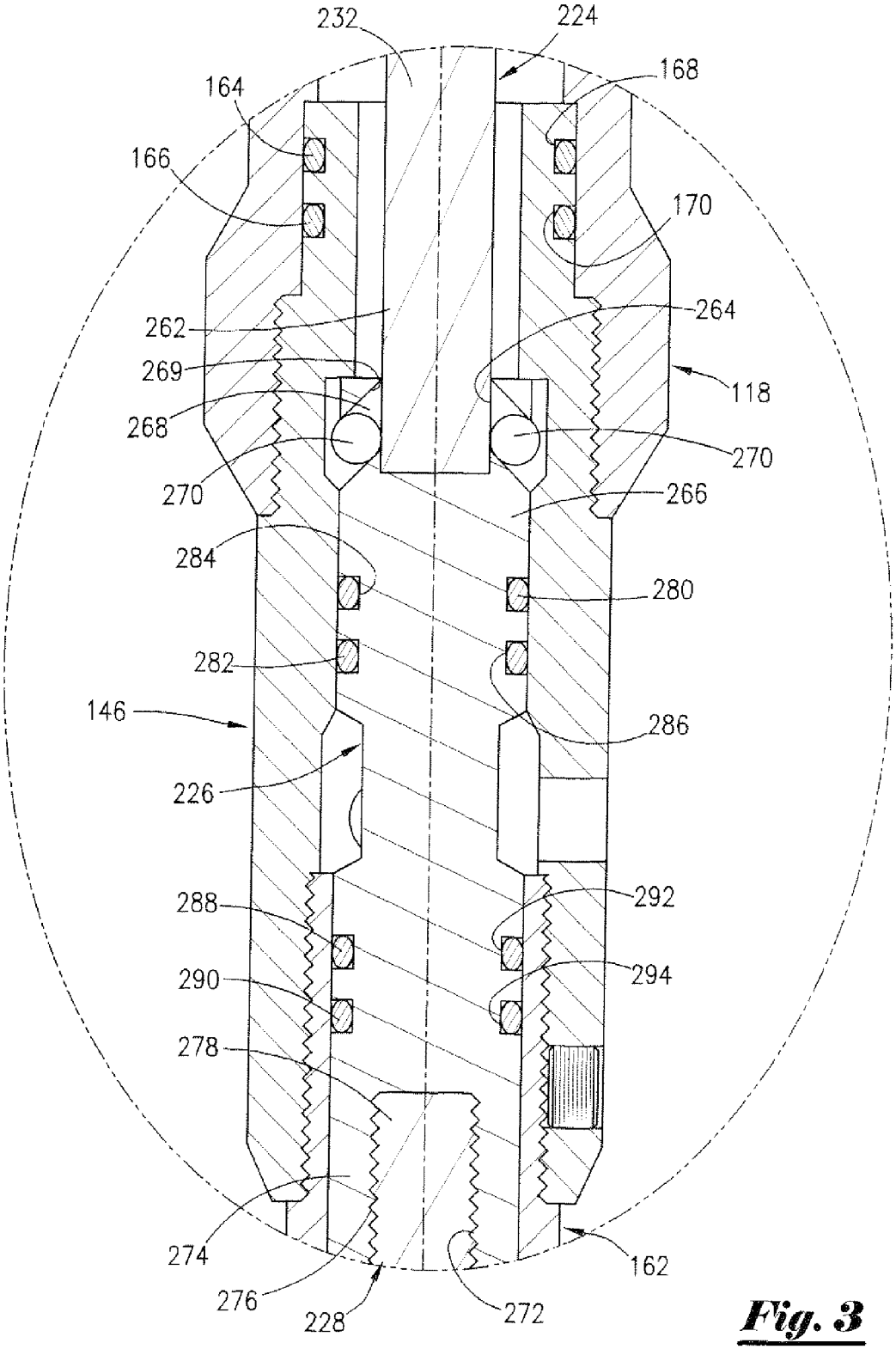
FIG. 3 is a partial cross-sectional view of the section designated as "3" in FIG. 1D.

FIGS. 1A-1B and 2 show that apparatus 10 also includes differential pressure piston 224, female locking piston 226, and firing rod 228 that are operatively interconnected and associated as will be explained. As shown in FIGS. 1A-1B, piston 224, piston 226 and firing rod 228 are in their non-actuated position. Piston 224 includes plunger section 230 and stem section 232. Plunger section 230 is positioned at lower end 234 of bore 108 of member 88 and extends down and into bore 130 of housing 106. Stem section 232 extends from plunger section 230 within bore 130 of housing 106 and extends downward into bore 152 of sealing member 118 and into bore 174 of housing 146. O-rings 236, 238 are seated in grooves 240, 244 in upper end 246 of plunger section 230 to provide an annular seal between upper end 246 of plunger section 230 and member 88. O-rings 248, 250 are seated in grooves 252, 254 in lower end 256 of plunger section 230 to provide an annular seal between lower end 256 of plunger section 230 and sealing member 118. Grooves or recesses 258, 260 each contain a portion of respective shear pins or screws 134. Shear pins or screws 134 hold piston 224 (and operatively associated piston 226 and firing rod 228) in a non-actuated position until such time that a pre-determined well bore fluid pressure is applied to shear pins or screws 134 to cause pins or screws 134 to be sheared thereby freeing piston 224. The pre-determined fluid pressure is applied to pins or screws 134 via orifice 128. Lower end 256 of plunger section 230 cooperatively engages internal shoulder 136 of housing 106 in the non-actuated position. Shoulder 136 acts to maintain the stationary positioning of piston 224 (and operatively associated piston 226 and firing rod 228) when apparatus 10, namely, sealing member 118, impacts the top end of the pipe joint containing the cooperative profile after being dropped from the well surface and falling within the drill pipe string.

With reference to FIG. 2, O-rings 238, 248, 250 are the same size with O-ring 236 being larger than O-rings 238, 248, 250. The commonality in size of O-rings 238, 248 permits the pre-determined pressure to be achieved in order to shear screw or pins 134 without premature movement of the firing rod 228. Because O-ring 236 is larger than the others, once screw or pins 134 are sheared, the well pressure causes piston 224 to move in an upward direction placing firing rod 228 in a firing position. When piston 224 has moved sufficiently upward, well pressure through orifice 128 then bears down on piston 266 which causes the downward movement of firing rod 228. Orifice 172 is now able to break circulation and permit drilling fluid to exit the drill pipe string on the way out of the well.

With further reference to FIGS. 1A-1F and 3, lower end 262 of stem section 232 of piston 224 is inserted within recess 264 in upper section 266 of piston 226. Upper section 266 of piston 226 contains internal groove 268 that has downward tapered surface 269. Groove 268 contains a plurality of metal (e.g., steel) balls 270 that make supporting contact with lower end 262 of stem section 232 when lower end 262 is positioned in recess 264. Internal threads 272 on lower section 274 of piston 226 threadedly connect with mating external threads 276 on upper section 278 of firing rod 228. O-rings 280, 282 are seated in grooves 284, 286 in upper section 266 of piston 226 to provide an annular seal between upper section 266 of piston 226 and housing 146. O-rings 288, 290 are seated in grooves 292, 294 in lower section 274 of piston 226 to provide an annular seal between lower section 274 of piston 226 and housing 162. Balls 270 provide an impact force transferring function. Impact forces caused by the seating of sealing member 118 in the profile at the top end of the pipe joint after apparatus 10 is dropped down the drill pipe string from the well surface are transferred from piston 224 to balls 270 to thereby hold firing rod 228 in its stationary non-actuated position.

With reference to FIGS. 1A-1F, upper section 278 of firing rod 228 is positioned within bore 181 of housing 162 and extends downward and into bore 203 of member 190. Lower section 296 of firing rod 228 contains tip end 298.

To operate apparatus 10, the operator would drop apparatus 10 (including the connected explosion activated tool such as a jet cutter or hole punching device) from the well surface, through the drill pipe string, to the targeted area where the drill pipe is to be worked upon. The profile on the top end of the pipe joint connected to the drill pipe string in the area catches sealing member 118 such that the profile on the top end of the pipe joint and profile 148 mate and form a metal-to-metal partial or full seal so that the well bore fluid pressure may be increased above sealing member 118. The seal formed does not need to be a complete seal but the metal-to-metal seating must be such as to permit the fluid pressure above the seating to be increased to a pre-selected amount to shear screws or pins 134. The operator then increases the fluid pressure to a pre-determined level sufficient to shear the shear pins or screws 134 thereby releasing piston 224. Piston 224 is an unbalanced area piston that provides a larger working area upward than downward. So, pressuring up in the well bore will generate more force upward than downward. The amount of force required to free piston 224 is determined by the number of shear pins or screws 134 used and controls the pressure at which apparatus 10 is initiated. The number of shear pins or screws 134 used is set a pre-determined value safely above the maximum BHP due to fluid hydrostatics as would be known to a person skilled in this art.

Once shear pins or screws 134 are sheared, piston 224 is displaced upward. Plunger section 230 will move upwards to top end 300 of internal bore 108 of member 88. Bore 108 is a sealed bore at atmospheric pressure. Lower end 262 of stem section 232 of piston 224 is displaced from recess 264 of upper section 266 of piston 226 causing metal balls 270 to fall out of piston 226. Piston 226 is a balanced piston. Therefore, the hydrostatic pressure now acts on piston 226 causing piston 226 and attached firing rod 228 to move downward driving tip end 298 of firing rod 228 into a percussion detonator in igniter sub 212. The detonator sets off the tool such as a jet cutter, which cuts the pipe joint or a hole puncher with punches holes in the pipe joint. The drill pipe, as for example, the stuck drill pipe string, is detached from the remainder of the drill pipe string at the cutting point. The up-hole section of drill pipe string may be retrieved from the well.

Apparatus 10 may be may of metal such as steel. The sealing means such as the O-rings may be made of rubber or an elastomeric material. The rubber cup assemblies may be made of rubber or an elastomeric material. The length and outer diameter size of apparatus 10 is based in part on the inner diameter of the drill pipe string through which apparatus 10 will be deployed. The outer diameter of the sealing member is based in part on the inner diameter of the bore in the profile at the top end of the pipe joint. The outer diameter of the sealing member must be larger than the inner diameter of the profile so that it seat within the profile to form a partial metal-to-metal seal.

The drill pipe string may be made up with one or more pipe joints placed at spaced-apart positions within the string. For example, three pipe joints may be included in spaced-apart relationship in the drill pipe string where there may be potential for worked to be performed on the well or drill pipe, e.g., where the drill pipe may become stuck. The profile at the top end of the each pipe joint contains a pre-selected sized diameter to receive a specified-sized sealing member 118. The lowest placed pipe joint would have the smallest sized-diameter profile, the middle pipe joint would have a larger sized-diameter profile, and the upper most pipe joint would have an even larger sized-diameter profile. Thus, apparatus 10 could be made up with sealing member 118 having an outer diameter sized to pass through the first two pipe joints and seat within the lowest pipe joint. Optionally, apparatus 10 could be made up with sealing member 118 having an outer diameter sized to pass through the upper most pipe joint and be received by the second or middle-placed pipe joint. Optionally, apparatus 10 could be made up with sealing member 118 having an outer diameter sized to be received by the upper most pipe joint.

Each pipe joint may be about 6 to 10 feet in length. Apparatus 10 is made up such that the components extending below sealing member 118 extend into the pipe joint about 3 feet.

In an alternative embodiment, first cup mandrel 26 and/or second cup mandrel 66 may be connected within apparatus 10 in the opposite direction (upside down) so that cups 28, 68, rather than providing a drag force, act to push apparatus 10 down the drill pipe string by fluid pressure applied at the well surface. In this configuration, apparatus 10 is not dropped and does not free fall to the pipe joint but instead is pushed down the drill pipe string to the pipe joint by fluid pressure.

While preferred embodiments of the present invention have been described, it is to be understood that the embodiments described are illustrative only and that the scope of the invention is to be defined solely by the appended claims when accorded a full range of equivalents, many variations and modifications naturally occurring to those skilled in the art from a perusal hereof.

What is claimed is:

1. An apparatus for deploying and activating a downhole tool activated by an explosive charge comprising:

an upper tubular member having an upper section and a lower section;

a sealing plug member having an upper section and a lower section, the upper section of the sealing plug member detachably connected to the lower section of the upper tubular member;

an upper piston cylinder member having an upper section, a lower section, and an internal bore, the upper section of the upper piston cylinder member detachably connected in sealing relationship to the lower section of the sealing plug;

a shear pin housing member having an upper section, a lower section, an internal shoulder, an internal bore, and an orifice providing a well bore fluid passageway to the internal bore of the shear pin housing member;

a sealing member having an upper section, a lower section, an internal bore, and an external wedge-shaped profile adapted to form a partial seal within a drill pipe string sufficient to cause an increase in fluid pressure above the sealing member, the upper section of the sealing member detachably connected in sealing relationship to the lower section of the shear pin housing;

a lower seal housing having an upper section, a lower section, and an internal bore, the upper section of the lower seal housing detachably connected in sealing relationship to the lower section of the sealing member;

a lower tubular member having an upper section, a lower section, and an internal bore, the upper section of the lower tubular member detachably connected in sealing relationship to the lower section of the lower seal housing;

an ignitor sub having an upper section and a lower section, the upper section of the ignitor sub detachably connected in sealing relationship with the lower section of the lower tubular member;

a differential pressure piston having a plunger section and a stem section, the plunger section having an upper end and a lower end, the stem section having a lower end, the upper end of the plunger section including one or more sealing means, the lower end of the plunger section including one or more sealing means, wherein the lower end of the plunger section cooperatively engages the shoulder of the shear pin housing member when the differential pressure piston is in a stationary, non-actuated position;

a female locking piston having an upper section and a lower section, the upper section of the female locking piston containing a recess accommodating the lower end of the stem section of the differential pressure piston when the differential pressure piston is in the stationary, non-actuated position, the upper section of the female locking piston including an impact force absorbing means operatively associated with the lower end section of the stem section of the differential pressure piston, the female locking piston including a plurality of sealing means;

a firing rod having an upper section and a lower section, the upper section of the firing rod detachably connected to the lower section of the female locking piston;

wherein the shear pin housing member includes one or more shear pins selectively retaining the differential pressure piston in the stationary, non-actuated position.

2. The apparatus of claim 1 wherein the upper tubular member comprises:

a first mandrel member having an upper section, a lower section, and an external rubber cup assembly, the upper section of the first mandrel member detachably connected to the lower section of the retrieving member;

a first coupling member having an upper section and a lower section, the upper section of the first coupling member detachably coupled to the lower section of the first mandrel member;

a longitudinally extending tubular member having an upper section, a lower section, and a mid-section containing a bow string centralizer assembly, the upper section of the longitudinally extending tubular member detachably coupled to the lower section of the first coupling member;

a second coupling member having an upper section and a lower section, the upper section of the second coupling member detachably coupled to the lower section of the longitudinally extending tubular member; and a second mandrel member having an upper section, a lower section, and an external rubber cup assembly, the upper section of the second mandrel member detachably connected to the lower section of the second coupling member, the lower section of the second mandrel member detachably connected to the upper section of the sealing plug member.

3. The apparatus of claim 2 wherein the external rubber cup assembly of the first and second mandrel members each includes a plurality of rubber cup-like projections adapted to cause a well bore fluid drag force during deployment of the apparatus in the drill pipe string or receiving a fluid pressure force to push the apparatus down the drill pipe string during deployment.

4. The apparatus of claim 3 wherein the bow string centralizer assembly comprises a plurality of centralizers adapted to cause a drag force by contacting an inner bore wall of the drill pipe string during deployment of the apparatus.

5. The apparatus of claim 1 wherein the sealing plug member includes one or more annular sealing means.

6. The apparatus of claim 5 wherein the shear pin housing member includes one or more annular sealing means.

7. The apparatus of claim 1 wherein the lower seal housing comprises:

a first seal housing member having an upper section, a lower section, and an internal bore, the upper section of the first seal housing detachably connected in sealing relationship to the lower section of the sealing member;

a second seal housing having an upper section, a lower section, and an internal bore, the upper section of the second seal housing detachably connected to the lower section of the first seal housing, the lower section of the second seal housing detachably connected in sealing relationship to the upper section of the lower tubular member.

8. The apparatus of claim 7 wherein the lower section of the first seal housing includes one or more recesses, each recess housing a set screw to maintain the connection of the lower section of the first seal housing to the upper section of the second seal housing.

9. The apparatus of claim 8 wherein the lower section of the second seal housing includes one or more annular sealing means.

10. The apparatus of claim 1 wherein the lower tubular member includes a bow string centralizer assembly.

11. The apparatus of claim 10 wherein the bow string centralizer assembly comprises a plurality of centralizers adapted to cause a drag force by contacting an inner bore wall of the drill pipe string during deployment of the apparatus.

12. The apparatus of claim 11 wherein the lower section of the lower tubular member includes one or more annular sealing means.

13. The apparatus of claim 1 wherein the impact force absorbing means comprises a groove and a plurality of metal balls retained within the groove, and wherein in the stationary, non-actuated position, the lower end of the stem section of the differential pressure piston is contacted by the metal balls.

14. The apparatus of claim 13 wherein the groove includes a downward tapered surface.

15. The apparatus of claim 13, wherein the metal balls are made of steel.

16. The apparatus of claim 13 wherein when the differential pressure piston is in a fully actuated position, the shear pins have sheared at a pre-determined well bore fluid pressure, the differential pressure piston has moved upwards within the internal bore of the upper piston cylinder member displacing the lower end of the stem section of the differential pressure piston from the recess in the upper section of the female locking piston causing the metal balls to be displaced from the groove in the upper section of the female locking piston, the female locking piston and connected firing rod have moved downward causing the lower section of the firing rod to actuate the ignitor sub.

17. The apparatus of claim 1 further comprising a retrieving member including an upper section and a lower section, the upper section of the retrieving member having a fish neck profile for connection of a fishing tool, and wherein the upper section of the upper tubular member is detachably connected to the lower section of the retrieving member.

18. The apparatus of claim 1 wherein the one or more sealing means of upper end of the plunger section comprise an upper O-ring and a lower O-ring and wherein the one or more sealing means of the lower end of the plunger section comprise an upper O-ring and a lower O-ring.

19. The apparatus of claim 18 wherein the lower O-ring of the upper end of the plunger section and the upper and lower O-rings of the lower end of the plunger section each have a ring-diameter size that is equal.

20. The apparatus of claim 19 wherein the upper O-ring of the upper end of the plunger section has a ring-diameter size larger than the ring-diameter size of the lower O-ring of the upper end of the plunger section and the upper and lower O-rings of the lower end of the plunger section.

* * * * *